US006824626B2

(12) United States Patent
Charrette et al.

(10) Patent No.: US 6,824,626 B2
(45) Date of Patent: Nov. 30, 2004

(54) GAS-GENERATING PYROTECHNIC COMPOSITIONS WITH A BINDER AND CONTINUOUS MANUFACTURING PROCESS

(75) Inventors: Dimitri Charrette, Merignac (FR); Georges Chounet, Le Bouscat (FR)

(73) Assignee: SNPE, Paris (FR)

( * ) Notice: Subject to any disclaimer, the term of this patent is extended or adjusted under 35 U.S.C. 154(b) by 0 days.

(21) Appl. No.: 10/003,082

(22) Filed: Dec. 6, 2001

(65) Prior Publication Data

US 2002/0079031 A1 Jun. 27, 2002

(30) Foreign Application Priority Data

Dec. 22, 2000 (FR) ..... 00 16879

(51) Int. Cl.[7] ..... C06B 45/10; C06B 31/02; C06B 29/22

(52) U.S. Cl. ..... 149/19.91; 149/61; 149/76

(58) Field of Search ..... 149/19.91, 61, 149/76

(56) References Cited

U.S. PATENT DOCUMENTS

| | | | | |
|---|---|---|---|---|
| 3,698,316 A | * | 10/1972 | Evans | 149/93 |
| 3,723,205 A | | 3/1973 | Scheffee | |
| 3,839,105 A | | 10/1974 | Dewitt et al. | |
| 3,964,256 A | | 6/1976 | Plantif et al. | |
| 3,986,908 A | | 10/1976 | Grebert et al. | |
| 4,298,412 A | * | 11/1981 | Biddle et al. | 149/19.1 |
| 4,315,785 A | * | 2/1982 | Brodman et al. | 149/19.8 |
| 4,604,151 A | | 8/1986 | Knowlton et al. | |
| 5,171,385 A | * | 12/1992 | Michels et al. | 149/19.1 |
| 5,458,706 A | * | 10/1995 | Finck et al. | 149/19.2 |
| 5,610,444 A | | 3/1997 | Austruy et al. | |
| 5,753,853 A | * | 5/1998 | Monte et al. | 149/19.2 |
| 5,780,767 A | * | 7/1998 | Matsuda et al. | 149/2 |
| 5,780,768 A | * | 7/1998 | Knowlton et al. | 149/36 |
| 5,861,571 A | * | 1/1999 | Scheffee et al. | 102/288 |
| 6,123,359 A | * | 9/2000 | Cabrera et al. | 280/741 |
| 6,224,099 B1 | * | 5/2001 | Nielson et al. | 149/45 |
| 6,485,587 B1 | * | 11/2002 | Han et al. | 149/19.92 |
| 6,517,647 B1 | * | 2/2003 | Yamato | 149/61 |

FOREIGN PATENT DOCUMENTS

| | | |
|---|---|---|
| GB | 964 801 A | 7/1964 |
| WO | WO 97/12846 | 4/1997 |
| WO | WO 98/08782 | 3/1998 |
| WO | WO 98/47836 | 10/1998 |
| WO | WO 99/31029 | 6/1999 |

* cited by examiner

*Primary Examiner*—Aileen Felton
(74) *Attorney, Agent, or Firm*—Oliff & Berridge, PLC

(57) ABSTRACT

The invention is directed to a solvent-free gas-generating pyrotechnic composition, and a method for continuously manufacturing the composition in a twin-screw mixer-extruder, the composition including a binder, a nitrogenous organic compound, an oxidizing filler, and optionally at least one additive; the oxidizing filler including an ammonium perchlorate and a chlorine scavenger; the binder including at least one polymer, having a molecular mass greater than 200,000 and selected from a polyester polymer and an acrylic ester, and wherein the binder uncliding at least one liquid constituent selected from a polyester resin and a plasticizer.

18 Claims, 1 Drawing Sheet

GAS-GENERATING PYROTECHNIC COMPOSITIONS WITH A BINDER AND CONTINUOUS MANUFACTURING PROCESS

BACKGROUND OF THE INVENTION

1. Field of Invention

The present invention relates to the technical field of the pyrogenic generation of gases which can be used in particular in systems for protecting the occupants of a motor vehicle by means of bags which are inflated by the combustion gases from a pyrotechnic charge. More specifically, the invention relates to pyrotechnic compositions which generate clean and nontoxic gases at temperatures acceptable for motor vehicle safety. The invention also relates to a process for the continuous manufacture of such compositions.

2. Description of Related Art

For various pyrotechnic requirements and in particular to provide correct inflation of airbags, pyrotechnic gas generators have to provide, in extremely short times, of the order of thirty milliseconds, gases which are clean, that is to say devoid of solid particles capable of constituting hot points which may damage the wall of the bag, and nontoxic, that is to say with low contents of nitrogen oxides, of carbon oxides and of chlorinated products.

Various families of pyrotechnic compositions have been developed for this purpose.

A first family relates to compositions based on alkali metal azide or alkaline earth azide in the presence of an inorganic oxidizing agent, such as potassium nitrate, or of a metal oxide. These compositions, which may if appropriate comprise a binder, exhibit major disadvantages. First, they produce, during their combustion, a good deal of dust, which has to be filtered out using relatively large filtration systems, which increases both the weight and the cost of the generator. Secondly, the azides are highly toxic products which additionally exhibit the possibility of forming azides of lead or of other heavy metals, which are primary explosives. These compositions are therefore difficult to store under satisfactory conditions for several years in a motor vehicle.

A second family relates to compositions based on nitrocellulose and on nitroglycerine. These compositions, also known under the name of "double-base powders", are highly advantageous as they burn very quickly and without producing dust. However, they nonetheless exhibit the disadvantage of not being completely stable over time, and at high temperature.

A third family relates to "composite" compositions composed essentially of an organic binder and of an oxidizing inorganic filler, such as, in particular, an inorganic perchlorate. These compositions are a priori highly advantageous as they exhibit a good rate of combustion and an excellent stability with regard to ageing.

Compositions have thus been provided, by Patent FR-A-2 137 619 or by its equivalent U.S. Pat. No. 3,723,205, in which the binder is a poly(vinyl chloride) and in which the oxidizing filler is an ammonium perchlorate, in the presence of sodium nitrate as internal chlorine scavenger. Nevertheless, the use of a chlorinated binder in the presence of energy-generating fillers is a problematic operation, in particular with regard to safety and the nontoxicity of the gases generated.

Provision has also been made for composite compositions composed of a silicone binder which can crosslink at ambient temperature, also known under the name of RTV (Room Temperature Vulcanizable), and of potassium perchlorate, the potassium atom acting as internal chlorine scavenger. Such compositions are, for example, disclosed in Patents FR-A-2 190 776 and FR-B-2 213 254 or in their United States equivalents U.S. Pat. No. 3,986,908 and U.S. Pat. No. 3,964,256. However, these compositions exhibit the disadvantage of generating gases which are very rich in oxygen, which gases are not desirable for manufacturers in the motor vehicle industry.

There also exist composite compositions composed of a silicone binder and of a mixture of ammonium perchlorate and of sodium nitrate. Such compositions do not comprise a solvent. They are, for example, disclosed in French Patent FR-A-2 728 562 or in its United States equivalent U.S. Pat. No. 5,610,444. These compositions certainly generate clean, nitrogen-rich and nontoxic gases but exhibit the disadvantage of burning at very high temperatures and of producing a high level of solid waste.

The processes for the manufacture of the existing compositions involve the presence of a solvent for adjusting the viscosity. The use of a solvent has many disadvantages, in particular industrially. The solvent has to be removed from the composition and there is a risk of the pyrotechnic charge becoming porous during this operation.

SUMMARY OF THE INVENTION

A person skilled in the art is therefore constantly looking for solvent-free gas-generating pyrotechnic compositions which generate, at temperatures acceptable for the motor vehicle industry, clean and nontoxic gases with very little solid waste. A person skilled in the art is also looking for a process for the continuous manufacture of such compositions, in particular in the form of blocks.

The object of the present invention is specifically to provide such compositions and a process which allows them to be prepared.

The invention thus relates to a gas-generating pyrotechnic composition comprising a binder, a nitrogenous organic compound, additives and an oxidizing filler comprising ammonium perchlorate and a chlorine scavenger, the said binder being a hydrocarbonaceous binder with at least two components, one of the components being composed of a gum, characterized in that, when the gum is a polyester gum, it is used in combination with a polyester resin and in that, when the gum is an acrylic gum, it is used in combination with one of its plasticizers.

The term "gum" is used to describe a polymer with a molecular mass of greater than 200 000. The acrylic gums used are also known as acrylic rubbers or poly-acrylates. These gums can have reactive endings of chlorine/carboxyl, chlorine, hydroxyl or epoxy type.

The polyester gums used are rubbers with ester units which can have reactive endings of hydroxyl type.

The term "resin" is used to describe a hydrocarbonaceous polymer with a molecular mass of between 100 and 10 000.

According to a first preferred embodiment, the binder is composed of the combination of an acrylic gum and of one of its plasticizers. The plasticizer of the acrylic gum is chosen from the group consisting of dioctyl adipate and dioctyl azelate.

A crosslinking agent will generally be used in combination with the binder.

According to a second preferred embodiment, the binder is composed of the combination of a polyester gum and of a polyester resin. According to this preferred embodiment, the composition additionally comprises a crosslinking agent of isocyanate type.

According to a third preferred embodiment, the content by weight of the fillers is greater than or equal to 85% of the total weight of the composition. The term "fillers" is understood to mean simultaneously the oxidizing fillers, the nitrogenous organic compounds and the other additives.

The oxidizing filler comprises ammonium perchlorate and a chlorine scavenger. The chlorine scavenger is chosen from the group consisting of sodium nitrate, calcium carbonate, lithium carbonate, potassium nitrate, strontium nitrate, barium nitrate, potassium chlorate, potassium perchlorate and copper oxide.

Sodium nitrate is a preferred chlorine scavenger.

The composition also comprises a nitrogenous organic compound. The nitrogenous organic compound is chosen from the group consisting of nitroguanidine, guanidine nitrate, aminoguanidine nitrate, oxamide, dicyandiamide, guanylurea dinitramide and metal cyanamides. The content by weight of this nitrogenous compound is preferably between 3 and 15% of the total weight of the composition.

According to a fourth preferred embodiment, the composition additionally comprises a ballistic catalyst chosen from the group consisting of titanium oxide, copper oxide, basic copper nitrate, copper chromite and iron oxide. Iron oxide is the preferred ballistic catalyst. The content by weight of the ballistic catalyst is preferably between 0% and 4% of the total weight of the composition.

It makes it possible, inter alia, to improve the rate of combustion.

According to a fifth preferred embodiment, the composition additionally comprises a wetting agent. This wetting agent is chosen from the group consisting of organosilanes, titanates and aziridines. Trialkyl-silanes in which the functional group is a vinyl, epoxy, amine or methacrylic group are the preferred organosilanes.

The content by weight of the wetting agent is preferably between 0.5 and 2% of the total weight of the composition.

This component makes it possible to reduce the residual porosity of the product.

The ballistic catalyst and the wetting agent constitute the preferred additives of the compositions according to the invention.

The invention also relates to a process for the continuous and solvent-free manufacture in a twin-screw mixer-extruder of such compositions, characterized in that:

- the twin-screw mixer-extruder comprises a mixing and kneading compartment, a compression compartment and an extrusion head, and in that
- the solid and liquid constituents are introduced into the mixing and kneading compartment via two different feed openings, a feed opening for the solids and a feed opening for the liquids, and in that they are, in this compartment, conveyed and kneaded, then, in that,
- the homogeneous paste thus formed is degassed in the compression compartment and then extruded, using an extrusion head, in the form of rods and, finally, in that,
- the rods thus formed are cut up into charges using a cutting device, and in that these said charges are crosslinked at a temperature of between 100° C. and 150° C.

According to a preferred alternative form of the invention, the nitrogenous organic compound and the gum are premixed and introduced into the mixing and kneading compartment via the feed opening for the solids.

According to another preferred alternative form of the invention, the pressure in the compression compartment is less than $50\times10^3$ Pa, i.e. 500 mbar.

The temperature in the mixing and kneading compartment is between 15° C. and 75° C.

The pressure in the extrusion head is between $6\times10^6$ Pa and $15\times10^6$ Pa, i.e. between 60 bar and 150 bar.

The essential novel feature of the invention lies in the fact that the hydrocarbonaceous binder comprises, first, a gum and, secondly, a liquid constituent which is either a resin or a plasticizer. A pasty binder is thus obtained. When the oxidizing filler, the nitrogenous organic compound and the various additives are incorporated in this binder, the composition is sufficiently strong to be extruded in the form of rods. There is therefore no need either for a thickening agent or for a solvent.

The rods are subsequently cut up into charges and the structure of the binder is permanently fixed by crosslinking in an oven at a temperature of between 100° C. and 150° C.

BRIEF DESCRIPTION OF THE DRAWINGS

Various exemplary embodiments of this invention will be described in detail, with reference to the following figure, wherein.

DETAILED DESCRIPTION OF PREFERRED EMBODIMENTS

Figure 1:
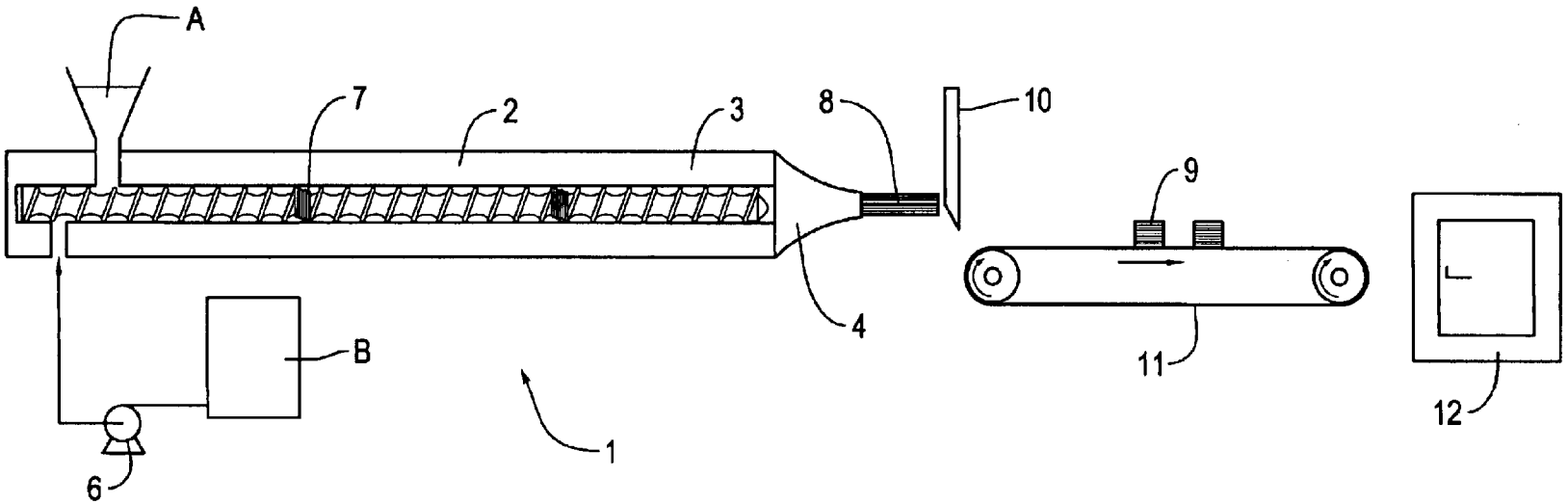
FIG. 1 represents, in the form of a diagram partially in section, a plant which makes possible the implementation of the process according to the invention.

A detailed description of the preferred embodiment of the invention is now given with reference to FIG. 1, which represents, in the form of a diagram partially in section, a plant which makes possible the implementation of the process according to the invention.

The twin-screw extruder-mixer 1 comprises an upstream part 2 in which the operations of mixing and kneading the composition take place, a downstream part 3 in which the operation of degassing the composition takes place, and an extrusion head 4.

During operation, a plug of material is formed which separates the upstream part 2 from the downstream part 3.

In the continuation of the present description, the upstream part 2 will be referred to as "mixing and kneading compartment" and the downstream part 3 will be referred to as "compression compartment".

The gum and the nitrogenous organic compound are premixed. Preferably, the gum will be an acrylic gum and the nitrogenous compound will be guanidine nitrate.

In the start-up phase, first the inert constituents, namely the plasticizer and the various additives, are introduced. Subsequently, the oxidizing fillers and the gum/nitrogenous organic compound mixture are introduced. Once the start-up phase is complete, the various constituents are introduced continuously into the mixing and kneading compartment. The solids A are introduced without solvent by means of a hopper. The liquids B are introduced without solvent by means of a metering pump 6. The liquids B are composed of the plasticizer and the wetting agent. The solids A are the acrylic gum/guanidine nitrate mixture, the oxidizing filler, comprising ammonium perchlorate, and the additives other than the wetting agent.

Use is made of ammonium perchlorate particles with two different particle sizes. The particle size is between 10 $\mu$m and 50 $\mu$m.

As the ammonium perchlorate produces chlorinated derivatives on combustion, a chlorine scavenger is added to it. The preferred chlorine scavenger in the context of the invention is sodium nitrate, which fixes the chlorine in the form of sodium chloride which is submicronic in size and which thus presents no risk of damage to the walls of the inflatable bag.

The sodium nitrate will also be introduced via the feed opening for the solids A. The ratio of the ammonium perchlorate to the sodium nitrate is between 1 and 2.

The level of oxidizing fillers is preferably approximately 80% of the total weight of the composition, in order to have a composition which is sufficiently well balanced in terms of oxygen balance.

The content by weight of the fillers (that is to say, oxidizing filler, nitrogenous organic compound and additives) is greater than or equal to 85% of the total weight of the composition. These are therefore compositions with a binder with a high load of fillers. The content of binder and crosslinking agents in the composition will advantageously be in the region of 15%.

The preferred additives are the wetting agent and the ballistic catalyst. The preferred ballistic catalyst is iron oxide.

The constituents are conveyed and kneaded in the mixing and kneading compartment 2. The constituents are kneaded by means of the kneading elements 7, so as to form a homogeneous paste. The temperature within this compartment is between 15° C. and 75° C.

The paste formed in the mixing and kneading compartment 2 is subsequently degassed in the compression compartment 3, under a pressure of less than $30\times10^3$ Pa, i.e. 300 mbar.

This paste is subsequently extruded, by means of an extrusion head 4, in the form of rods 8. The pressure in the extrusion head is preferably in the region of 100 bar.

These rods are then cut up into charges 9 using a cutting device 10. These charges 9 are recovered by a conveyor belt 11 and conveyed to an oven 12. This oven 12 is heated to a temperature of between 100 and 150° C. Preferably, this oven is heated to 120° C. The charges remain in this oven for approximately 3 hours, so as to complete the crosslinking of the constituents of the binder and thus to fix the structure of the charges 9.

In a particularly preferred way, the charges 9 have the form of hollow cylindrical blocks generally exhibiting axial channels.

The charges thus formed have a preferred application as pyrotechnic charge in generators of gases intended to inflate an airbag for occupants of a motor vehicle.

This is because the rate of combustion of these charges, the level of solid waste produced and the level of carbon monoxide and of nitrogen oxides which are produced are particularly well suited to the requirements of motor vehicle safety.

The examples which follow illustrate, without implied limitation, some possible implementations of the invention.

EXAMPLE 1

The following gas-generating composition was manufactured according to the process represented in FIG. 1:

acrylic gum: 5.5% of the total weight of the composition plasticizer (dioctyl adipate or dioctyl azelate): 6.5% of the total weight of the composition.

The content of binder is thus 12% of the total weight of the composition.

ammonium perchlorate with a bimodal particle size not exceeding 50 $\mu$m: 60.5% by weight, the fine perchlorate being in excess by weight with respect to the perchlorate with the larger particle size.

sodium nitrate: 20% by weight.

The content of oxidizing fillers is 80.5% by weight.

guanidine nitrate: 5% by weight iron oxide: 1.5% by weight wetting agent (vinylsilane): 1% by weight.

The content by weight of the fillers is 88%.

The combustion temperature of this composition is of the order of 2 400° C.

The rate of combustion is 33 mm/s at 20 MPa.

The characteristics of the gases from the combustion of 18 g of such a composition are as follows:

overall content of solid waste in the gases at the combustion temperature: 15.5% content of carbon monoxide in the gases, for a volume of 60 1: 4 500 ppm content of nitrogen oxides in the gases, for a volume of 60 1: 1 000 ppm.

EXAMPLE 2

The following gas-generating composition was manufactured according to the process represented in FIG. 1:

acrylic gum: 6.6% of the total weight of the composition plasticizer (dioctyl adipate or dioctyl azelate): 5.5% of the total weight of the composition.

The content of binder is thus 12.1% of the total weight of the composition.

ammonium perchlorate with a bimodal particle size not exceeding 50 $\mu$m: 58.5% by weight, the perchlorate with the larger particle size being in excess with respect to the fine perchlorate.

sodium nitrate: 15.9% by weight basic copper nitrate: 6.5% by weight.

The content of oxidizing fillers is 80.9% by weight.

wetting agent (vinylsilane): 1% by weight guanidine nitrate: 6% by weight.

The content by weight of the fillers is 87.9%.

The combustion temperature of this composition is of the order of 2 400° C.

The rate of combustion is 43 mm/s at 20 MPa.

The characteristics of the gases from the combustion of 18 g of such a composition are as follows:

overall content of solid waste in the gases at the combustion temperature: 14.6% content of carbon monoxide in the gases, for a volume of 60 1: 4 500 ppm content of nitrogen oxides in the gases, for a volume of 60 1: 1 000 ppm.

EXAMPLE 3

The following gas-generating composition was manufactured according to the process represented in FIG. 1:

polyester gum: 3.46% by weight polyester resin: 8.76% by weight crosslinking agent (methylenedicyclohexyl diisocyanate): 2.78% by weight.

The content of binder and of crosslinking agent is thus 15% by weight.

ammonium perchlorate with a bimodal particle size not exceeding 50 μm: 54% by weight, the perchlorate with the larger particle size being in excess with respect to the fine perchlorate.

sodium nitrate: 15.5% by weight copper oxide: 7% by weight.

The content of oxidizing fillers is 76.5% by weight.

guanidine nitrate: 8.5% by weight.

The content by weight of the fillers is 85%.

The combustion temperature of this composition is of the order of 2 400° C.

The rate of combustion is 20 mm/s at 20 MPa.

The characteristics of the gases from the combustion of 18 g of such a composition are as follows:

overall content of solid waste in the gases at the combustion temperature: 16.3% content of carbon monoxide in the gases, for a volume of 60 1: 4 500 ppm content of nitrogen oxides in the gases, for a volume of 60 1: 800 ppm.

What is claimed is:

1. A solvent-free gas-generating pyrotechnic composition, comprising:

a binder, a nitrogenous organic compound, an oxidizing filler, and optionally at least one additive;

wherein said oxidizing filler comprises an ammonium perchlorate and a chlorine scavenger;

wherein said binder comprises at least one solid polymer consisting of an acrylic polymer having a molecular mass greater than 200,000, and reactive endings of a type selected from the group consisting of chlorine/carboxyl, chlorine, hydroxyl or epoxy, and wherein said binder comprises at least one liquid constituent consisting of a plasticizer.

2. The composition according to claim 1, wherein said acrylic polymer is selected from the group consisting of acrylic rubbers and polyacrylates.

3. The composition according to claim 1, wherein said plasticizer is selected from the group consisting of dioctyl adipate and dioctyl azelate.

4. The composition according to claim 1, wherein said binder comprises a cross-linking agent.

5. The composition according to claim 4, wherein said cross-linking agent is an isocyanate-type cross-linking agent.

6. The composition according to claim 1, wherein the content by weight of the nitrogenous compound, the oxidizing filler, and the optional at least one additive is at least 85% of the total weight of the composition.

7. The composition according to claim 1, wherein said chlorine scavenger is selected from the group consisting of sodium nitrate, calcium carbonate, lithium carbonate, potassium nitrate, strontium nitrate, barium nitrate, potassium chlorate, potassium perchlorate and copper oxide.

8. The composition according to claim 7, wherein said chlorine scavenger is sodium nitrate.

9. The composition according to claim 1, wherein said nitrogenous organic compound is selected from the group consisting of nitroguanidine, guanidine nitrate, aminoguanidine nitrate, oxamide, dicyandiamide, guanylurea dinitramide and metal cyanamides.

10. The composition according to claim 1, comprising a ballistic catalyst.

11. The composition according to claim 10, wherein said ballistic catalyst is selected from the group consisting of titanium oxide, copper oxide, basic copper nitrate, copper chromite and iron oxide.

12. The composition according to claim 1, comprising a component reducing the residual porosity.

13. The composition according to claim 12, wherein said component reducing the residual porosity is selected from the group consisting of organosilanes, titanates and aziridines.

14. A method for continuously manufacturing the solvent-free composition of claim 1, in a twin-screw mixer-extruder comprising a mixing and kneading compartment, a compression compartment and an extrusion head, said method comprising:

introducing solid and liquid constituents into said mixing and kneading compartment through two different feed openings in said twin-screw mixer-extruder, forming a homogenous paste by conveying and kneading said solid and liquid components, degassing said homogenous paste, extruding said homogenous paste, with said extrusion head, into rods, cutting said rods into charges with a cutting device, and cross-linking said charges at a temperature between about 100° C. and about 150° C.

15. The method according to claim 14, further comprising premixing said nitrogenous organic compound and said polymer to form a premixture, and introducing said premixture into said mixing and kneading compartment through a solids feed opening.

16. The method according to claim 14, wherein a pressure in said compression compartment is less than about $50\times10^3$ Pa.

17. The method according to claim 14, wherein a temperature in said mixing and kneading compartment is between about 15° C. and about 75° C.

18. The method according to claim 14, wherein a pressure in said extrusion head is between about $6\times10^6$ Pa and about $15\times10^6$ Pa.

* * * * *